US009905103B2

(12) United States Patent
Hsieh

(10) Patent No.: US 9,905,103 B2
(45) Date of Patent: Feb. 27, 2018

(54) ACTIVE PROTECTION SYSTEM

(71) Applicants: Sintai Optical (Shenzhen) Co., Ltd., Shenzhen, Guandong Province (CN); Asia Optical International Ltd., Taichung (TW)

(72) Inventor: Wen-Hung Hsieh, Taichung (TW)

(73) Assignee: SINTAI OPTICAL (SHENZHEN) CO., LTD. & ASIA OPTICAL INTERNATIONAL LTD., Taichung (TW)

( * ) Notice: Subject to any disclaimer, the term of this patent is extended or adjusted under 35 U.S.C. 154(b) by 0 days.

(21) Appl. No.: 14/999,146

(22) Filed: Apr. 4, 2016

(65) Prior Publication Data

US 2016/0314676 A1 Oct. 27, 2016

(30) Foreign Application Priority Data

Apr. 21, 2015 (CN) ..... 2015 1 0190511

(51) Int. Cl.
*G08B 17/10* (2006.01)
*G08B 17/12* (2006.01)

(52) U.S. Cl.
CPC ..... *G08B 17/125* (2013.01)

(58) Field of Classification Search
CPC ..... G08B 17/125
See application file for complete search history.

(56) References Cited

U.S. PATENT DOCUMENTS 9,501,828 B2 * 11/2016 Takiguchi ..... G06T 7/0028
2004/0170262 A1 * 9/2004 Ohno ..... H04L 12/2803 379/167.12
2005/0156730 A1 * 7/2005 Chapman, Jr. ..... F24F 11/0001 340/506
2006/0115154 A1 * 6/2006 Chen ..... G08B 17/125 382/181
2006/0249679 A1 * 11/2006 Johnson ..... G01C 3/08 250/332
2007/0030161 A1 * 2/2007 Yang ..... F24C 7/08 340/679
2007/0268462 A1 * 11/2007 Shih ..... G03B 21/16 353/60

(Continued)

OTHER PUBLICATIONS

Soran, Action Recognition in the Presence of One Egocentric and Multiple Static Cameras, Apr. 17, 2015.*

*Primary Examiner* — Quang D Pham
(74) *Attorney, Agent, or Firm* — McClure, Qualey & Rodack, LLP

(57) ABSTRACT

An active protection system for protecting an object includes a first lens, a second lens, a processing unit and an alarm unit. The first lens is configured to receive first light and generate a first image. The second lens is configured to receive second light and generate a second image. The processing unit is configured to obtain a characteristic value of the object from the second image, determine whether the characteristic value reaches a pre-set value, and judge whether the object is regulated in a predetermined period after the characteristic value reaches the pre-set value. The alarm unit is configured to raise an alarm under control of the processing unit if the object is not regulated in the predetermined period after the characteristic value reaches the pre-set value.

16 Claims, 4 Drawing Sheets

(56) References Cited

U.S. PATENT DOCUMENTS

2008/0149834 A1* 6/2008 Bernhardt ..... D21G 9/00 250/330
2009/0050806 A1* 2/2009 Schmidt ..... H04N 5/2254 250/332
2009/0222671 A1* 9/2009 Burbank ..... A61B 5/117 713/186
2011/0043630 A1* 2/2011 McClure ..... A61B 5/1116 348/143
2012/0314066 A1* 12/2012 Lee ..... G08B 17/125 348/143
2013/0278524 A1* 10/2013 Wang ..... G06F 3/0416 345/173
2015/0070518 A1* 3/2015 Chang ..... H04N 5/23267 348/208.2
2015/0204556 A1* 7/2015 Kusukame ..... F24F 11/0034 1/34
2016/0042532 A1* 2/2016 Lo ..... G06T 7/11 382/100
2016/0119592 A1* 4/2016 Stuart ..... H04Q 9/00 348/82
2016/0149718 A1* 5/2016 Kido ..... G08B 13/19684 348/143
2016/0248847 A1* 8/2016 Saxena ..... H04L 67/18

* cited by examiner

ACTIVE PROTECTION SYSTEM

BACKGROUND OF THE INVENTION

Field of the Invention

The invention relates to an active protection system, and more particularly to an active protection system having at least two lenses to collect two different kinds of information of an object and determining whether the object is in an abnormal condition according to the information so as to provide an alarm and protection.

Description of the Related Art

A conventional protection system usually includes a smoke alarm device disposed on a ceiling to detect smoke or harmful gas such as liquid petroleum gas or CO gas. However, when the smoke alarm device raises an alarm, fire or harmful gas has already occurred and may pose a danger to people's life or property.

BRIEF SUMMARY OF THE INVENTION

An object of the invention is to provide an active protection system including at least two lenses to capture at least two different kinds of images of an object for determining whether the object is in an abnormal condition so as to provide an alarm and protection.

The active protection system for protecting an object in accordance with an exemplary embodiment of the invention includes a first lens, a second lens, a processing unit and an alarm unit. The first lens is configured to receive first light and generate a first image. The second lens is configured to receive second light and generate a second image. The processing unit is configured to obtain a characteristic value of the object from the second image, determine whether the characteristic value reaches a pre-set value, and judge whether the object is regulated in a predetermined period after the characteristic value reaches the pre-set value. The alarm unit is configured to raise an alarm under control of the processing unit if the object is not regulated in the predetermined period after the characteristic value reaches the pre-set value.

In another exemplary embodiment, the first light includes visible light.

In yet another exemplary embodiment, the second light includes infrared light.

In another exemplary embodiment, the characteristic value is temperature of the object.

In yet another exemplary embodiment, the first lens has a higher pixel resolution than the second lens.

The active protection system for protecting an object in accordance with another exemplary embodiment of the invention includes a first lens, a second lens, a processing unit and a communication unit. The first lens is configured to receive first light and generate a first image. The second lens is configured to receive second light and generate a second image. The processing unit is configured to obtain a characteristic value of the object from the second image, determine whether the characteristic value reaches a pre-set value, and judge whether the object is regulated in a first predetermined period after the characteristic value reaches the pre-set value. The communication unit connects to a terminal device through a network, wherein the processing unit sends an alarm signal to the terminal device if the object is not regulated in the first predetermined period after the characteristic value reaches the pre-set value.

In another exemplary embodiment, the processing unit sends a first control signal if receiving no response from the terminal device in a second predetermined period after the alarm signal is sent, the active protection system further comprises a signal transmitting unit configured to transmit the first control signal to a control device, and the control device is configured to regulate the object so that the characteristic value becomes less than the pre-set value when the control device receives the first control signal.

In yet another exemplary embodiment, the terminal device is configured to send a second control signal through the communication unit to the processing unit, and the processing unit sends the first control signal to the control device when receiving the second control signal.

In another exemplary embodiment, the first light comprises visible light.

In yet another exemplary embodiment, the second light comprises infrared light.

In another exemplary embodiment, the characteristic value is temperature of the object.

In yet another exemplary embodiment, the processing unit sends the alarm signal and the first image to the terminal device when the characteristic value reaches the pre-set value.

In another exemplary embodiment, the processing unit is further configured to combine the first image and the second image to a composite image.

In yet another exemplary embodiment, the processing unit sends the composite image and the alarm signal to the terminal device when the characteristic value reaches the pre-set value.

In another exemplary embodiment, the communication unit is connected to the network, either wirelessly or via cable.

In yet another exemplary embodiment, the first lens has a higher pixel resolution than the second lens.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
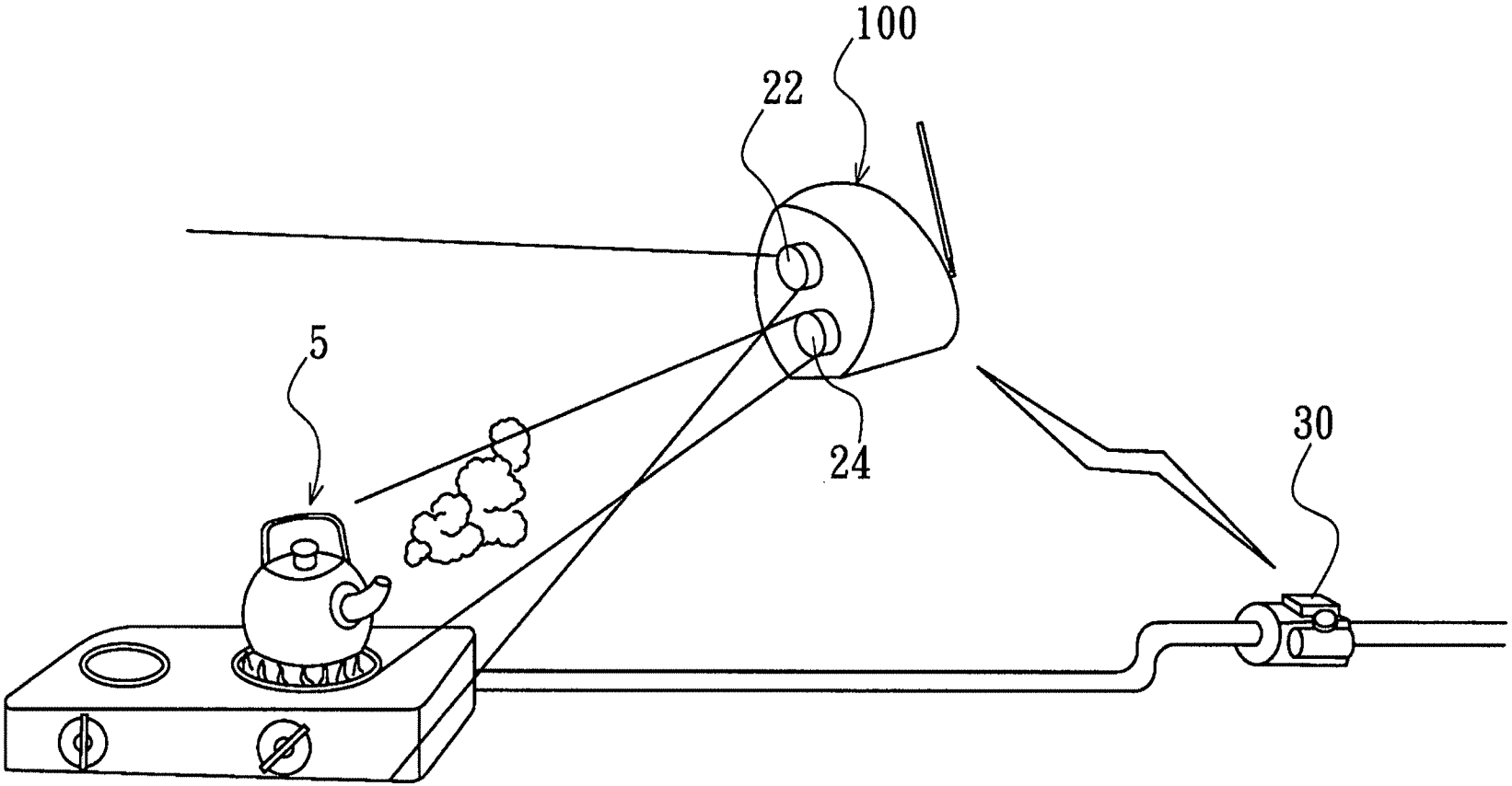
FIG. 1 is a schematic view of an active protection system of the invention.
Figure 2:
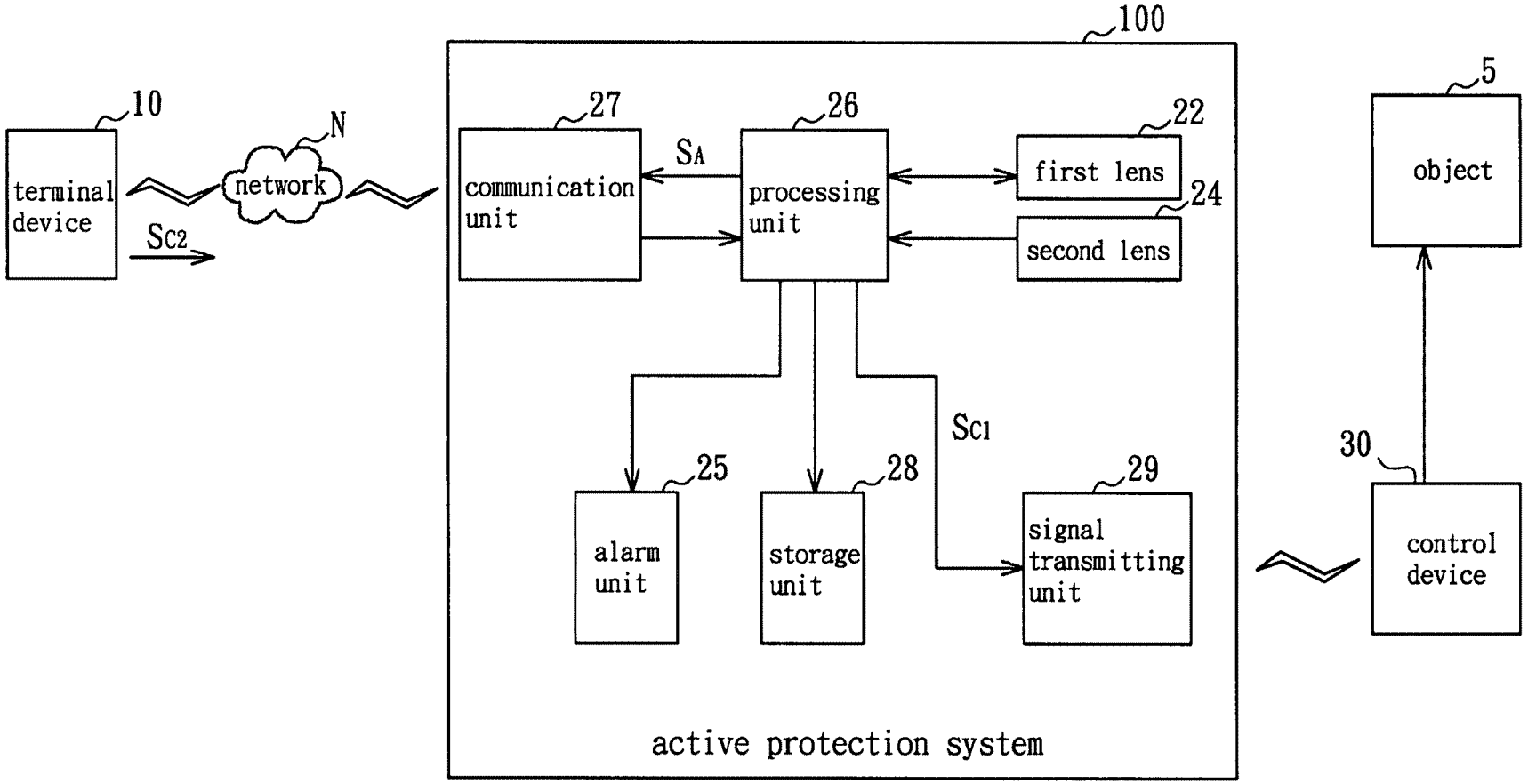
FIG. 2 is a block diagram of an embodiment of an active protection system of the invention.

Referring to FIGS. 1 and 2, an active protection system 100 for monitoring an object 5 is shown. In this embodiment, the active protection system 100 is used to monitor and actively protect a stove in a kitchen.

Referring to FIG. 2, the active protection system 100 for monitoring the object 5 includes a first lens 22, a second lens 24, an alarm unit 25, a processing unit 26, a communication unit 27, a storage unit 28 and a signal transmitting unit 29.

The first lens 22 is configured to receive first light and generate a first image, and the second lens 24 is configured to receive second light and generate a second image. The processing unit 26 is configured to process the first image and the second image and save the first image and the second image in the storage unit 28.

In this embodiment, the object 5 is a kettle on a stove in a kitchen, the first light is visible light, and the second light is infrared light. The first lens 22 is closed in normal condition. The second lens 24 is operated all the time to receive infrared light irradiated from the stove and generate the second image which is transmitted to the processing unit 26. The processing unit 26 processes and analyzes the second image to judge whether a characteristic value of the object 5 reaches a pre-set value. For example, the processing unit 26 judges whether a temperature of the kettle on the stove reaches 100° C. when water in the kettle is heated.

When the second image indicates that the temperature of the kettle reaches 100° C., the processing unit 26 actuates the first lens 22 to receive the first light (visible light) and generate the first image. The processing unit 26 determines whether a person enters the kitchen to regulate or turn off the stove according to the first image. If the processing unit 26 determines that a person has entered the kitchen to regulate or turn off the stove according to the first image, the processing unit 26 continues to monitor the kettle on the stove without raising an alarm or sending information and the second lens 24 is kept to operate. On the contrary, if the processing unit 26 determines that no person enters the kitchen according to the first image, the processing unit 26 controls the alarm unit 25 to raise an alarm for altering persons nearby to regulate or turn off the stove (to regulate the object). Also, the processing unit 26 sends information about the situations in the kitchen to a terminal device 10 through a network N to inform a person using the terminal device 10 at the far end. The terminal device 10 may be a mobile phone, a tablet or other smart devices capable of connecting to a network.

A person using the terminal device 10 at the far end is able to receive an alert and/or view the scene image through the network N. In detail, the processing unit 26 generates an alarm signal $S_A$. The communication unit 27 transmits the alarm signal $S_A$ to the terminal device 10 through the network N. The processing unit 26 may further transmit the first image to the terminal device 10 through the network N. In this embodiment, the terminal device 10 is a smart device (e.g. smart phone). When receiving the alarm signal $S_A$ and the first image, the smart device alerts the person by ringing or oscillating and displays the first image. When the person notices the alert and views the first image (the scene image of the kettle in the kitchen) displayed by the smart device, he/she can operate the terminal device 10 to send a second control signal $S_{C2}$ to the active protection device 100 through the network N. The communication unit 27 of the active protection system 100 receives the second control signal $S_{C2}$ and transmits the second control signal $S_{C2}$ to the processing unit 26. When the processing unit 26 receives the second control signal $S_{C2}$, the processing unit 26 sends a first control signal $S_{C1}$ to a control device 30, and the control device 30 regulates the object 5 according to the first control signal $S_{C1}$. In this embodiment, the control device 30 is a gas relay.

If the person using the terminal device 10 does not notice the alarm or gives no response to the active protection system 100, then the processing unit 26 will not receive the second control signal $S_{C2}$ after the alarm signal $S_A$ is sent for a predetermined period. Under such a circumstance, the processing unit 26 actively sends the first control signal $S_{C1}$ to the control device 30 through the signal transmitting unit 29. After receiving the first control signal $S_{C1}$, the control device 30 regulates the object 5 (That is, the control device 30 regulates or turns off the stove). The signal transmitting unit 29 may transmit the first control signal $S_{C1}$ to the control device 30 either wirelessly or via cable.

Figure 3:
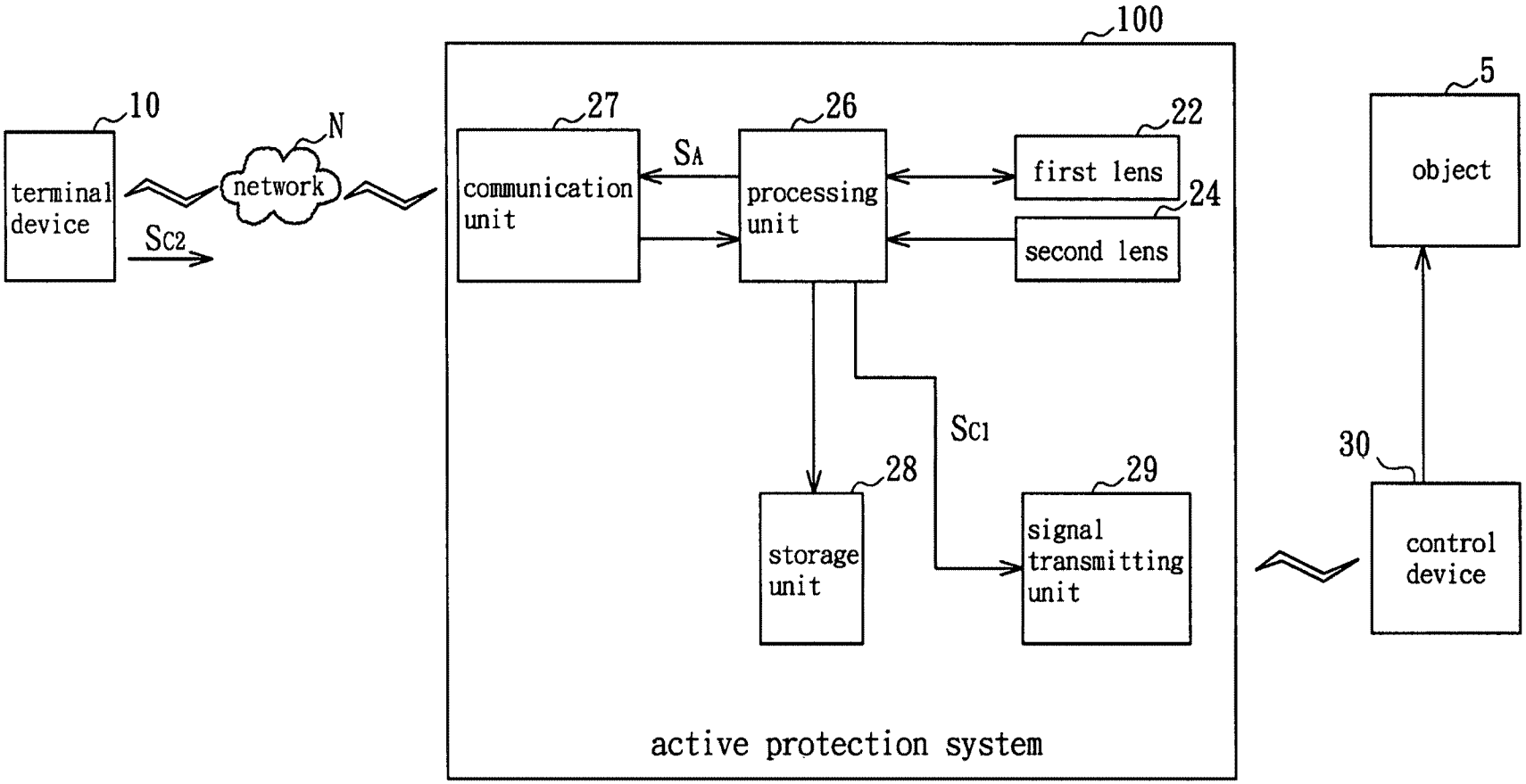
FIG. 3 is a block diagram of another embodiment of an active protection system of the invention.

FIG. 3 depicts another embodiment of the active protection system of the invention, wherein the same elements in this embodiment and the previous embodiment are given the same reference numerals. In this embodiment, the alarm unit 25 in the previous embodiment is not provided. When processing unit 26 determines that the temperature of the object 5 reaches the pre-set value according to the second image, the processing unit 26 activates the first lens 22 to receive the first light (visible light) and generate the first image. The processing unit 26 judges whether a person comes to the kitchen to regulate the object 5 according to the first image. If the processing unit 26 determines that a person has come to kitchen and regulated the stove according to the first image, then the processing unit 26 continues to monitor the stove without raising an alarm or sending information and the second lens 24 is kept to operate. On the contrary, if the processing unit 26 determines that no person comes to the kitchen according to the first image, then the processing unit 26 will send information about the situations in the kitchen to the terminal device 10 through a network N to inform a person using the terminal device 10 at the far end.

A person using the terminal device 10 is able to receive an alert and/or view the scene image. In operation, the person may view the first image (the image of the kitchen and the stove) through the screen of the terminal device 10. Also, the person may send a second control signals $S_{C2}$ to the active protection device 100 through the network N. In the active protection device 100, the communication unit 27 receives the second control signals $S_{C2}$ and transmits the second control signals $S_{C2}$ to the processing unit 26. When the processing unit 26 receives the second control signals $S_{C2}$, the processing unit 26 sends a first control signals $S_{C1}$ to the control device 30 to regulate the stove (object 5). In this embodiment, the control device 30 is a gas relay.

Figure 4A:
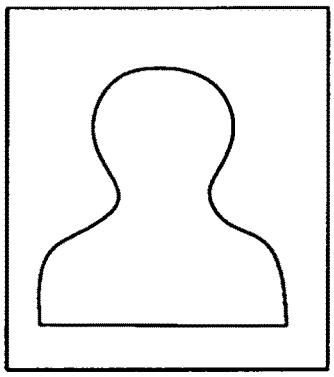
FIG. 4*a* depicts an image captured by a first lens of an active protection system of the invention.
Figure 4B:
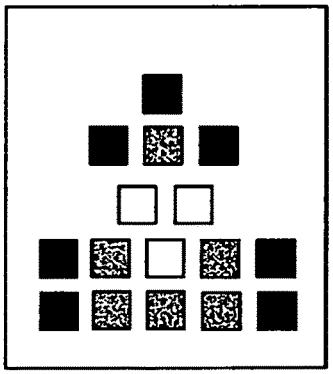
FIG. 4*b* depicts an image captured by a second lens of an active protection system of the invention.
Figure 4C:
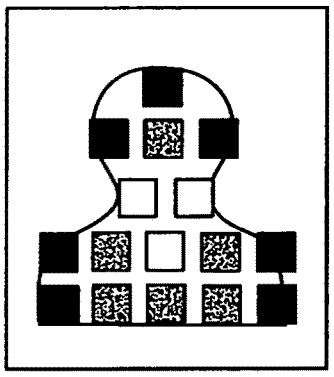
FIG. 4*c* depicts a composition image obtained by combining the images captured by the first lens and the second lens of an active protection system of the invention.

In the embodiments described above, the first lens has a higher pixel resolution than the second lens. For example, the first lens has two million pixels (2 MP), and the second lens has one thousand pixels. The second lens is an infrared lens which is expensive. To reduce cost, a low pixel infrared lens is used as the second lens. However, the infrared image generated by the second lens includes blurred color squares and is not easily recognized. On the other hand, the first lens is a high pixel visible-light lens which can generate an image with a clear outline. Therefore, the first image generated by the first lens and the second image generated by the second lens can be combined to obtain a composite image as shown in FIGS. 4*a* to 4*c*. FIG. 4*a* depicts the first image generated by the first lens, the outline of which is clear. FIG. 4*b* depicts the second image generated by the second lens, in which different styles of squares represent different temperatures of the portions of the object. FIG. 4*c* depicts the composite image obtained by combining the first image and the second image, wherein the squares overlap the clear image to indicate the temperatures of each portions of the clear image.

In the embodiments described above, the communication unit 27 may be connected to the network N either wirelessly or via cable.

In the embodiments described above, the active protection system 100 can also serve as an IP CAM.

In another embodiment, the processing unit 26 can combine the first image and the second image to a composite image. If the processing unit 26 determines that no person comes to the kitchen, the processing unit 26 sends the alarm signal $S_A$ and the composite image to the terminal device 10 through the network N and the communication unit 27 to inform the person using the terminal device 10.

The active protection system of the invention includes two lenses collecting different information of the object. The active protection system determines whether the object is in an abnormal condition according to the information. Users can remote control and protect the object through the active protection system of the invention.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An active protection system for monitoring an object, comprising:

a first lens configured to receive first light and generate a first image;

a second lens configured to receive second light and generate a second image;

a processing unit configured to obtain a characteristic value of the object from the second image, determine whether the characteristic value reaches a pre-set value, and judge whether the object is regulated in a first predetermined period of time after the characteristic value reaches the pre-set value based on the first image;

an alarm unit configured to raise an alarm under control of the processing unit if the object is not regulated in the predetermined period of time after the characteristic value reaches the pre-set value; and a communication unit configured to connect to a terminal device through a network, wherein the processing unit sends an alarm signal to the terminal device when the characteristic value reaches the pre-set value;

wherein the processing unit sends a first control signal if receiving no response from the terminal device in a second predetermined period after the alarm signal is sent, the active protection system further comprises a signal transmitting unit configured to transmit the first control signal to a control device, and the control device is configured to regulate the object so that the characteristic value becomes less than the pre-set value when the control device receives the first control signal; and wherein the terminal device is configured to send a second control signal through the communication unit to the processing unit, and the processing unit sends the first control signal, when receiving the second control signal.

2. The active protection system as claimed in claim 1, wherein the first light comprises visible light.

3. The active protection system as claimed in claim 1, wherein the second light comprises infrared light.

4. The active protection system as claimed in claim 3, wherein the characteristic value is temperature of the object.

5. The active protection system as claimed in claim 1, wherein the first lens has a higher pixel resolution than the second lens.

6. The active protection system as claimed in claim 1, wherein the first lens is closed in a condition that the characteristic value is less than the pre-set value, the second lens is operated at all times to receive the second light and generate the second image, and the processing unit actuates the first lens to receive the first light and generate the first image when the characteristic value reaches the pre-set value.

7. An active protection system for monitoring an object, comprising:

a first lens configured to receive first light and generate a first image;

a second lens configured to receive second light and generate a second image;

a processing unit configured to obtain a characteristic value of the object from the second image, determine whether the characteristic value reaches a pre-set value, and judge whether the object is regulated in a first predetermined period of time after the characteristic value reaches the pre-set value based on the first image; and a communication unit configured to connect to a terminal device through a network, wherein the processing unit sends an alarm signal to the terminal device if the object is not regulated in the first predetermined period of time after the characteristic value reaches the pre-set value;

wherein the processing unit sends a first control signal if receiving no response from the terminal device in a second predetermined period after the alarm signal is sent, the active protection system further comprises a signal transmitting unit configured to transmit the first control signal to a control device, and the control device is configured to regulate the object so that the characteristic value becomes less than the pre-set value when the control device receives the first control signal;

wherein the terminal device is configured to send a second control signal through the communication unit to the processing unit, and the processing unit sends the first control signal, when receiving the second control signal.

8. The active protection system as claimed in claim 7, wherein the first light comprises visible light.

9. The active protection system as claimed in claim 8, wherein the characteristic value is temperature of the object.

10. The active protection system as claimed in claim 7, wherein the second light comprises infrared light.

11. The active protection system as claimed in claim 7, wherein the processing unit sends the alarm signal and the first image to the terminal device when the characteristic value reaches the pre-set value.

12. The active protection system as claimed in claim 7, wherein the processing unit is further configured to combine the first image and the second image to a composite image.

13. The active protection system as claimed in claim 12, wherein the processing unit sends the composite image and the alarm signal to the terminal device when the characteristic value reaches the pre-set value.

14. The active protection system as claimed in claim 7, wherein the communication unit is connected to the network, either wirelessly or via cable.

15. The active protection system as claimed in claim 7, wherein the first lens has a higher pixel resolution than the second lens.

16. The active protection system as claimed in claim 7, wherein the first lens is closed in a condition that the characteristic value is less than the pre-set value, the second lens is operated at all times to receive the second light and generate the second image, and the processing unit actuates the first lens to receive the first light and generate the first image when the characteristic value reaches the pre-set value.

* * * * *